US005449038A

United States Patent [19]

Horton et al.

[11] Patent Number: 5,449,038

[45] Date of Patent: Sep. 12, 1995

[54] BATCH METHOD OF IN SITU STEAM GENERATION

[75] Inventors: Robert L. Horton, The Woodlands, Tex.; Sudarshan A. Mehta, Calgary, Canada; Robert G. Moore, Cochrane, Canada; Matthew G. Ursenbach, Calgary, Canada

[73] Assignees: Texaco Inc., White Plains, N.Y.; The University of Calgary, Calgary, Canada

[21] Appl. No.: 311,668

[22] Filed: Sep. 23, 1994

[51] Int. Cl.[6] ..... E21B 43/243

[52] U.S. Cl. ..... 166/260; 166/261

[58] Field of Search ..... 166/260, 261, 263

[56] References Cited

U.S. PATENT DOCUMENTS

| | | | |
|---|---|---|---|
| 3,087,541 | 4/1963 | Elzinga | 166/260 |
| 3,179,167 | 4/1965 | Strange et al. | 166/260 |
| 3,482,630 | 12/1969 | Earlougher, Jr. | 166/261 X |
| 3,830,300 | 8/1974 | Allen | 166/261 |
| 4,493,369 | 1/1985 | Odeh et al. | 166/261 |
| 4,566,537 | 1/1986 | Gussis | 166/261 |
| 4,593,759 | 6/1986 | Penick | 166/261 |
| 4,699,213 | 10/1987 | Fleming | 166/260 |
| 4,729,431 | 3/1988 | Bousaid | 166/261 |
| 4,860,827 | 8/1989 | Lee et al. | 166/261 |

*Primary Examiner*—George A. Suchfield

*Attorney, Agent, or Firm*—James L. Bailey; Kenneth R. Priem; Harold J. Delhommer

[57] ABSTRACT

A batch method of in situ steam generation for steamflooding which comprises injecting hydrocarbons into an upper zone of the formation to serve as fuel for in situ combustion, injecting oxidant into the lower zone causing at least a portion of the oxidant to contact and combust with the injected hydrocarbons, injecting water into the upper zone to be converted into steam by the hot formation, followed by ceasing oxidant injection, injecting a non-oxidant material into the lower zone so that the combustion zone does not approach the wellbore, and generating a steam front to drive formation hydrocarbons towards at least one production well.

10 Claims, No Drawings

BATCH METHOD OF IN SITU STEAM GENERATION

BACKGROUND OF THE INVENTION

The invention is a process for recovering hydrocarbons from an underground hydrocarbon-formation. More particularly, the invention relates to a batch method of generating steam with in situ combustion.

It is well recognized that primary hydrocarbon recovery techniques may recover only a portion of the petroleum in the formation. Thus, numerous secondary and tertiary recovery techniques have been suggested and employed to increase the recovery of hydrocarbons from the formations holding them in place. Thermal recovery techniques have proven to be effective in increasing the amount of oil recovered from the formation. Waterflooding and steamflooding have proven to be the most successful oil recovery techniques yet employed in commercial practice. Successes have also been achieved with in situ combustion processes.

An in situ combustion process requires the injection of sufficient oxygen-containing gas such as air to support and sustain combustion of the hydrocarbons in the reservoir. When the flow of the oxygen-containing gas in the reservoir is large enough, combustion will occur, either spontaneously or from an external heat source such as a downhole heater. A portion of the oil is burned as fuel at the high temperature front which proceeds slowly through the reservoir, breaking down the oil into various components, vaporizing and pushing the oil components ahead of the burning regions through the reservoir to the production wells.

Several methods have been suggested to improve in situ combustion drives. The most effective of these has been the method of wet combustion. In this case, a combustion drive is converted into wet combustion by the coinjection or alternate injection of water along with the oxygen-containing gas for combustion. A portion of the water that is injected flashes ahead of the combustion front to form a larger steam plateau which helps provide for greater displacement and oil recovery than a dry combustion process. Wet combustion offers the advantages of higher oil recovery, higher combustion front velocity, and lower fuel and air requirements than dry combustion.

Several combustion methods have been disclosed in which an in situ combustion process has been quenched in a floodout stage by the injection of water near the end of combustion. As a rule, the processes do not disclose the quenching of a combustion drive and refrain from such a step prior to reaching the end of the combustion phase of a method. U.S. Pat. No. 4,729,431 is an exception which discloses the intentional multiple quenching of an in situ combustion front.

U.S. Pat. No. 4,699,213 discloses a multistep process of injecting hydrocarbons, water and oxygen to generate steam in situ.

SUMMARY OF THE INVENTION

The invention is a batch method of in situ steam generation for steamflooding which comprises a multistep method. The first step is to inject steam through an injection wellbore into a lower zone of a hydrocarbon formation to sweep out hydrocarbons from the near wellbore area if the nature of the near wellbore area or hydrocarbons make this necessary.

Hydrocarbons are injected into an upper zone of the formation to serve as fuel for in situ combustion while an oxidant is injected into the lower zone causing at least a portion of the oxidant to contact and combust with the injected hydrocarbons. Water is injected into the upper zone to be converted into steam by the hot formation.

Oxidant injection is then ceased and a non-oxidant material is injected into the lower zone to make sure that the combustion zone does not approach the wellbore. Water and non-oxidant injection is continued to generate a steam front to drive formation hydrocarbons towards at least one production well.

Another embodiment involves the injection of hydrocarbons in a water-continuous emulsion of hydrocarbons, wherein the emulsion is formed with a surfactant that will thermally degrade under reservoir conditions near the combustion zone to release the hydrocarbons from the emulsion.

DETAILED DESCRIPTION

The idea of the invention process is to create an in situ combustion zone just outside the near wellbore area which is mostly stationary. This is different than the known in situ combustion art in that it is desired that the combustion zone not move substantially. Water is injected to increase the fuel and cost efficiency of the combustion zone process and be converted into a steam front which sweeps the formation.

The batch steps of the invention are repeated in cycles until economic limits are reached. The method is performed by first injecting steam through an injection wellbore into a lower zone of a hydrocarbon formation to sweep out hydrocarbons from the near-wellbore area if the nature of the near-wellbore area or hydrocarbons make this necessary. The entire near-wellbore area may be swept or only the lower zone may be swept. At least the lower zone should be swept since this is where the oxidant will be injected. Combustible hydrocarbons left in the lower zone may ignite near or in the wellbore upon the injection of oxidant. This is a situation to avoid as the wellbore may be damaged. Where the formation hydrocarbons are mostly condensate or light oil, it may be unnecessary to initially inject steam to sweep out the near wellbore area.

Hydrocarbons are injected into an upper zone of the hydrocarbon formation to serve as fuel for in situ combustion, while an oxidant is injected into the lower zone causing at least a portion of the oxidant to contact and combust with the injected hydrocarbons. If the initial steam injection or heat retained by the formation was insufficient to cause spontaneous combustion upon the contact of the oxidant with the injected hydrocarbons, then it may be necessary to also heat the formation further to temperatures sufficient to ignite the injected hydrocarbons. This may be done by more steam injection or other means, including but not limited to, igniters or microwave heating.

The hydrocarbons are injected into the upper zone and the oxidant is injected into the lower zone because as the two injected streams move out into the formation, the hydrocarbons will tend to move downwards and the oxidant will tend to move upwards. In this process, not only will the two streams move together at some distance from the wellbore, but the upward moving oxidant will tend to lift the hydrocarbons, reducing their tendency to underride, and the downward moving hydrocarbons will push downward on the oxidant, reducing its gaseous tendency to override.

Water is injected into the upper zone to be converted into steam by the hot formation. Oxidant injection is ceased, and non-oxidant material is injected into the lower zone to insure that the combustion front does not approach the wellbore.

Water and non-oxidant injection is continued to generate a steam front to drive formation hydrocarbons towards at least one production well. Although the injection of larger amounts of water will quench the combustion zone or front and provide steam, it is preferable to cease injection of the oxidant, which may be likened to choking the zone, instead of quenching the zone. When the oxidant is cut off, the front will quit moving due to lack of oxidant. Continued water injection will take advantage of the heat in the formation and add to the steamfront.

Contrary to common belief, it has been discovered that combustion zones that have been extinguished can be reignited. In most cases, reignition will require nothing more than the injection of an oxygen-containing gas. In some cases, additional external heat or higher oxygen content gas flux may be required. Such heat may be provided by the injection of steam, or by a temporary increase in the oxygen rate.

In general, hydrocarbon reservoirs are superbly insulated. They lose heat very slowly. Thus, even when a combustion zone has been extinguished by an excess of injected water, or the injection of too little air to support combustion, the reservoir will retain sufficient heat for reignition for several weeks or even months.

For reignition, it may be desirable to cease water injection in order to reignite the zone more rapidly with the injection of an oxygen-containing gas alone. However, it may not be necessary to completely cease water injection. In some cases, it may be sufficient to decrease the amount of water to a sufficient degree while increasing the oxidant rate to allow for reignition. But reignition occurs sooner and is more efficient by completely stopping water injection.

The oxidant is oxygen, air, chlorine dioxide, nitrogen dioxide, ozone, or an oxygen/gas mixture. The non-oxidant material is water or preferably, an inert gas such as carbon dioxide or nitrogen.

The injected hydrocarbons may be a heavy oil or a heavy oil bottoms fraction obtained from light oil by distillation, or in an alternate embodiment, the injected hydrocarbons can take the form of a water-continuous emulsion of hydrocarbons, formed with a surfactant that will thermally degrade under the higher temperature reservoir conditions to release the hydrocarbons from the emulsion. Such an emulsion will prevent the hydrocarbons from contacting oxidant until they are a desired distance into the formation, and also provide a method of delivering certain types of hydrocarbons into the reservoir for the process. These emulsions substantially reduce the danger of explosion, combustion or wet oxidation of the oil. Such emulsions have been used in Canada to transport heavy crudes and are successful in resisting inversion to oil external form even when exposed to extreme shear stress. When the surfactant concentration is diminished due to thermal decomposition, the emulsions invert and release the oil.

Another embodiment includes the additional injection of hazardous waste in a fine particulate solid form or a liquid form to be incinerated in the reservoir. Combustion products would be filtered through the formation, and in most cases, only steam, carbon dioxide, hydrogen and the like would reach the production wells and be allowed to vent into the atmosphere.

An additional embodiment involves the injection of a heavy oil in excess of that needed for combustion so as to upgrade the heavy oil by thermal cracking and producing light and intermediate hydrocarbons.

Many other variations and modifications may be made in the concepts described above by those skilled in the art without departing from the concept of the present invention. Accordingly, it should be clearly understood that the concepts disclosed in the description are illustrative only and are not intended as limitations on the scope of the invention.

What is claimed is:

1. A batch method of in situ steam generation for steamflooding, which comprises:

injecting steam through an injection wellbore into a lower zone of a hydrocarbon formation to sweep out hydrocarbons from the near-wellbore area;

injecting hydrocarbons into an upper zone of the hydrocarbon formation to serve as fuel for in situ combustion;

injecting an oxidant into the lower zone causing at least a portion of the oxidant to contact and combust with the injected hydrocarbons;

injecting water into the upper zone to be converted into steam by the hot formation;

ceasing oxidant injection;

injecting a non-oxidant material into the lower zone to ensure that the combustion zone does not approach the wellbore; and continuing water and non-oxidant injection to generate a steam front to drive formation hydrocarbons towards at least one production well.

2. The method of claim 1, wherein the non-oxidant material is water or an inert gas.

3. The method of claim 2, wherein the inert gas is carbon dioxide or nitrogen.

4. The method of claim 1, wherein the injected hydrocarbons is a heavy oil, or heavy oil fraction.

5. The method of claim 1, wherein the steps of claim 1 are repeated at least once beginning with the step of injecting hydrocarbons.

6. The method of claim 1, wherein the oxidant is oxygen, air, or an oxygen/gas mixture.

7. The method of claim 1, wherein the hydrocarbons are injected in the form of a water-continuous emulsion of hydrocarbons, said emulsion formed with a surfactant that will thermally degrade under reservoir conditions near the combustion zone to release the hydrocarbons from the emulsion.

8. The method of claim 1, further comprising heating the formation to temperatures sufficient to ignite the injected hydrocarbons if the formation is at an insufficient temperature after the initial steam injection step.

9. A batch method of in situ steam generation for steamflooding, which comprises:

injecting steam through an injection wellbore into a lower zone of a hydrocarbon formation to sweep out hydrocarbons from the near wellbore area;

injecting a water-continuous emulsion of hydrocarbons into an upper zone of a hydrocarbon formation, said emulsion formed with a surfactant that will thermally degrade under reservoir conditions to release the hydrocarbons from the emulsion;

injecting an oxidant into the lower zone of the formation, causing at least a portion of the oxidant to contact and combust with the injected hydrocarbons;

injecting water into the upper zone to be converted into steam by the hot formation;

ceasing oxidant injection;

injecting a non-oxidant material into the lower zone to ensure that the combustion zone does not approach the wellbore; and continuing water and non-oxidant injection to generate a steam front to drive formation hydrocarbons towards at least one production well.

10. The method of claim 9, wherein the steps of claim 9 are repeated at least once more beginning with the step of injecting the emulsion.

* * * * *